US006550106B2

(12) United States Patent
Pferdmenges et al.

(10) Patent No.: US 6,550,106 B2
(45) **Date of Patent: *Apr. 22, 2003**

(54) FIBER WEB GUIDING DEVICE FOR FORMING A SLIVER FROM A FIBER WEB

(75) Inventors: Gerd Pferdmenges, Jüchen (DE); Gregor Eschenbruch, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/052,444

(22) Filed: Jan. 23, 2002

(65) Prior Publication Data

US 2002/0062535 A1 May 30, 2002

Related U.S. Application Data

(63) Continuation-in-part of application No. 09/982,000, filed on Oct. 19, 2001, and a continuation-in-part of application No. 09/770,687, filed on Jan. 29, 2001, now Pat. No. 6,345,417.

(30) Foreign Application Priority Data

| | | |
|---|---|---|
| Jan. 29, 2000 | (DE) | 100 03 994 |
| Oct. 19, 2000 | (DE) | 100 51 917 |
| Oct. 20, 2000 | (DE) | 100 51 998 |
| Sep. 17, 2001 | (DE) | 101 45 733 |

(51) Int. Cl.[7] ..... D01G 25/00

(52) U.S. Cl. ..... 19/150; 19/157

(58) Field of Search ..... 19/65 A, 65 CR, 19/65 R, 150, 152, 153, 157, 98, 100, 101, 105, 106 R, 108, 112, 200, 201, 202, 203, 204, 205, 288, 296, 299; 226/196

(56) References Cited

U.S. PATENT DOCUMENTS

| | | | | |
|---|---|---|---|---|
| 2,640,229 A | * | 6/1953 | Gwaltney | 19/157 |
| 3,895,417 A | * | 7/1975 | Zimmermann, Jr. | 19/243 |
| 3,994,046 A | * | 11/1976 | Brown et al. | 19/150 |
| 4,497,089 A | | 2/1985 | Anahara et al. | |
| 5,018,246 A | | 5/1991 | Leifeld | |
| 5,461,757 A | * | 10/1995 | Leifeld | 19/150 |
| 6,345,417 B2 | * | 2/2002 | Leder et al. | 19/150 |

FOREIGN PATENT DOCUMENTS

| | | |
|---|---|---|
| EP | 0 493 343 | 7/1992 |
| GB | 1 372 513 | 10/1974 |
| GB | 1 402 402 | 8/1975 |
| GB | 1 513 743 | 6/1978 |

* cited by examiner

*Primary Examiner*—Gary L. Welch
(74) *Attorney, Agent, or Firm*—Robert Kinberg; Venable, LLP

(57) ABSTRACT

A fiber sliver producing apparatus includes an arrangement for making a running fiber web and a web gathering device which has a plurality of walls defining an inner space through which the fiber web runs in an advancing direction. The walls are stationary during operation of the apparatus. The web gathering device has a web gathering portion causing the running fiber web to converge and a web densifying portion, situated downstream of the web gathering portion as viewed in the advancing direction, for forming a running sliver from the web. The web densifying portion has an outlet opening of cross-sectionally rectangular outline and an opening width which is at least five times greater than the opening height. Upon discharge through the outlet opening, the sliver passes through cooperating rolls of a calender roll pair defining a bight in which the outlet opening of the web gathering device is disposed.

13 Claims, 5 Drawing Sheets

FIBER WEB GUIDING DEVICE FOR FORMING A SLIVER FROM A FIBER WEB

CROSS REFERENCE TO RELATED APPLICATION

This application is a continuation-in-part of U.S. patent application Ser. No. 09/770,687 filed Jan. 29, 2001 now U.S. Pat. No. 6,345,417 and Ser. No. 09/982,000 filed Oct. 19, 2001.

This application claims the priority of German Applications 100 03 994.4 filed Jan. 29, 2000, 100 51 917.2 filed Oct. 19, 2000 and 100 51 998.9 filed Oct. 20, 2000, which are incorporated herein by reference. The application also claims the priority of German Application 101 45 733.2 filed Sep. 17, 2001.

This invention relates to an apparatus integrated in a carding machine or a roller card unit for forming a sliver from a fiber web. The apparatus has a roll assembly, formed of a doffer, a stripping roll and a crushing roll pair or, in the alternative, a shoving roll pair. The apparatus further has a web gathering device followed by a calender (pull-off) roll pair. In its outlet region the web gathering device densifies the web and discharges a sliver. The sliver exiting the device is introduced into the calender roll pair.

In practice, in the fiber batt processing industry, roller card units and carding machines are used which, for forming a fiber web, have a transitional guide plate (open web triangle), a standing roll pair and a downstream-arranged calender unit. It is a disadvantage of these known arrangements that the cross section of the produced sliver significantly deviates from a rectangular shape. It is also a drawback that the fiber material is not uniformly distributed over the sliver cross section. The thus-produced intermediate product (sliver) leads to irregularities during further processing to obtain the final product, such as a hygiene item.

German patent document 22 50 834 describes a transverse web gathering device which has a conveyor belt and a conveyor roll, followed by a sliver trumpet to form a sliver from a fiber web. The fiber web, after being densified in a closed zone, leaves the transverse gathering device and runs through a sliver trumpet and calender rolls and is thereafter deposited into a sliver can. The roll nip in the transverse gathering device is narrow and the inlet of the trumpet is at a substantial distance from the outlet of the transverse gathering device. The outlet of the trumpet has a circular cross section, and thus the exiting sliver assumes a circular cross section as well. The trumpet outlet is situated at a distance upstream of the bight defined by the calender roll pair. Such an apparatus is not adapted to form a sliver having a rectangular—particularly sharp-edged—cross section. It is a further disadvantage of the known arrangement that because of the distances of the trumpet inlet from the transverse web gathering device, on the one hand, and the trumpet outlet from the calender nip, on the other hand, the processing of the fiber material having a significant amount of short fibers is not possible. Also, the above-noted relatively large distances do not allow a high delivery speed.

SUMMARY OF THE INVENTION

It is an object of the invention to provide an improved apparatus of the above-outlined type from which the discussed disadvantages are eliminated and which, in particular, produces an improved sliver having a rectangular cross section and which further permits a production rate higher than heretofore.

This object and others to become apparent as the specification progresses, are accomplished by the invention, according to which, briefly stated, the fiber sliver producing apparatus includes an arrangement for making a running fiber web and a web gathering device which has a plurality of walls defining an inner space through which the fiber web runs in an advancing direction. The walls are stationary during operation of the apparatus. The web gathering device has a web gathering portion causing the running fiber web to converge and a web densifying portion, situated downstream of the web gathering portion as viewed in the advancing direction, for forming a running sliver from the web. The web densifying portion has an outlet opening of cross-sectionally rectangular outline and an opening width which is at least five times greater than the opening height. Upon discharge through the outlet opening, the sliver passes through cooperating rolls of a calender roll pair defining a bight in which the outlet opening of the web gathering device is disposed.

By virtue of the measures according to the invention a sliver having a rectangular cross section may be produced which has a more uniform fiber distribution and a significantly increased output speed (at least 100 m/min) compared to prior art arrangements. In particular, the processing of the fiber material with a higher short-fiber proportion is advantageously feasible.

DESCRIPTION OF THE PREFERRED EMBODIMENTS

Figure 1:
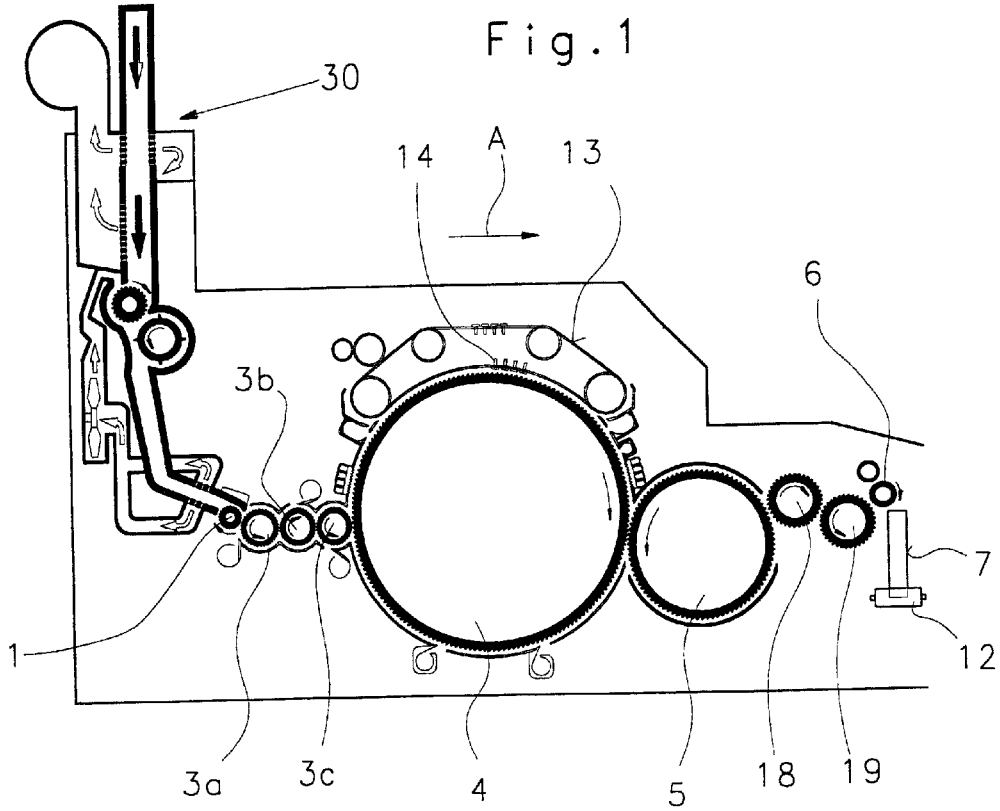
FIG. 1 is a schematic side elevational view of a carding machine incorporating the invention.

FIG. 1 illustrates a carding machine which may be, for example, a high-performance DK 903 model manufactured by Trützschler GmbH & Co. KG, Mönchengladbach, Germany. The carding machine has a feed roller 1, licker-ins 3*a*, 3*b*, 3*c*, a main carding cylinder 4, a doffer 5, a stripping roll 6, a web gathering device 7, a calender roll pair (only roll 12 thereof is visible), and a traveling flats assembly 13 having slowly circulating flat bars 14. A feeder 30 advances a fiber batt to the feed roller 1. The working direction of the carding machine (that is, the direction of fiber material flow therein) is designated at A. Between the doffer 5 and the stripping roll 6 two shoving rolls 18 and 19 are disposed which gather (accumulate) the fiber material to form a heavy web. The stripping roll 6 which, as viewed in FIG. 1, rotates clockwise, throws the fiber material downwardly into the web gathering device 7.

Figure 2:
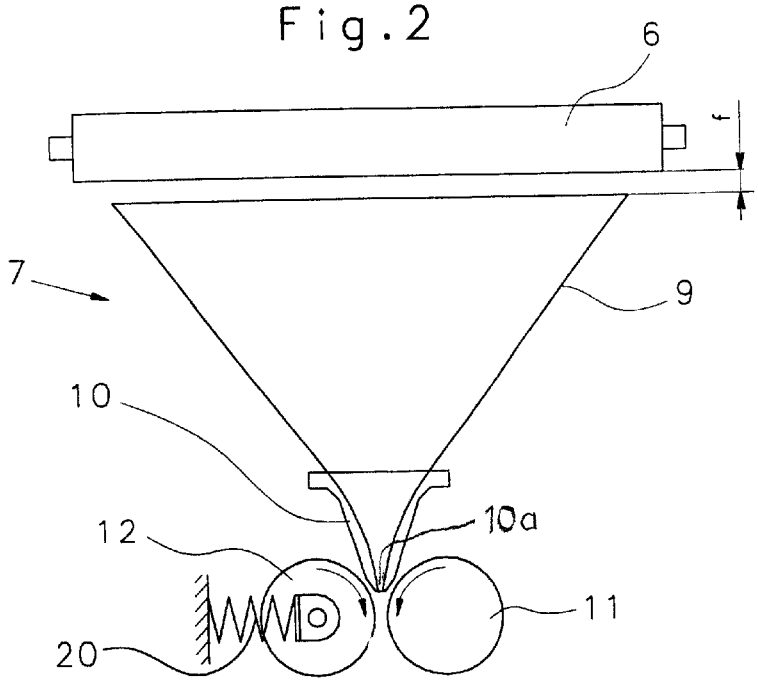
FIG. 2 is a schematic front elevational view of a preferred embodiment of the invention.

As shown in FIG. 2, the web gathering device 7 has, as viewed in the direction of material flow, a web gathering region adjoined by a web densifying region. As shown in FIG. 2, the web gathering device 7 is a two-piece structure: it is formed of a web guiding element 9 which constitutes the web gathering region and a web trumpet 10 which constitutes the web densifying region. The web guiding element 9 and the web trumpet 10 are closed on all sides except for the inlet and outlet openings for the fiber material. The inlet opening of the web guiding element 9 is at a distance f (for example, approximately 50 mm) from the stripping roll 6. The outlet opening 10*a* of the trumpet 10 extends into the bight formed by the converging circumferential surfaces of the two cooperating calender rolls 11 and 12. The calender roll 12 may radially shift toward and away from the calender roll 11 and is urged toward the calender roll 11 by a spring 20.

Figure 3A:
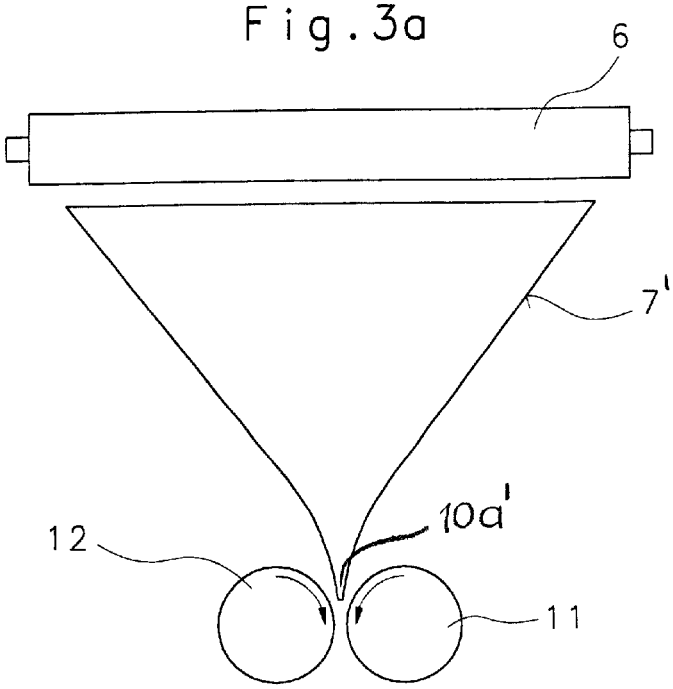
FIG. 3*a* is a schematic front elevational view of another preferred embodiment of the invention.

Turning to FIG. 3*a,* the web gathering device 7' illustrated therein is a one-piece construction. The outlet opening 10*a*' of the web gathering device 7' corresponds to the outlet opening 10*a* of the web trumpet 10 and reaches into the generally triangular space (bight) formed by the converging circumferential surfaces of the calender rolls 11 and 12. All the wall surfaces of the web gathering device 7 of FIG. 2 and of the web gathering device 7' of FIG. 3*a* are stationary during operation, that is, the fiber material slides along the inner wall faces of the web gathering devices 7, 7'.

Figure 3B:
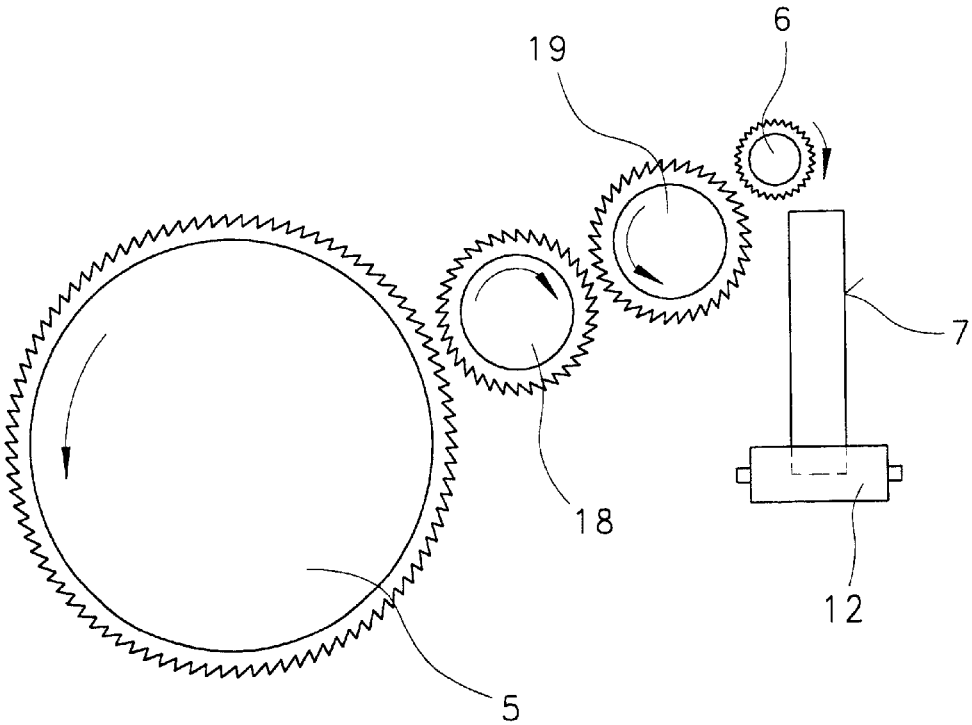
FIG. 3*b* is a schematic side elevational view of a variant of FIG. 1.

As seen in FIG. 3*b,* the shoving rolls 18 and 19 and the stripping roll 6 are, as viewed in the working direction of the fiber processing apparatus, at increasing height levels relative to the doffer 5, whereby the fiber material is lifted to a certain height. By virtue of such an arrangement the web gathering device 7 may be arranged underneath the stripping roll 6 so that gravity aids the raised web material to drop into the web gathering device 7 to thus support the flow of material. The calender rolls 11, 12 (only the latter is visible in FIG. 3*b*) pull the densified sliver from the outlet opening of the web gathering device 7.

Figure 4:
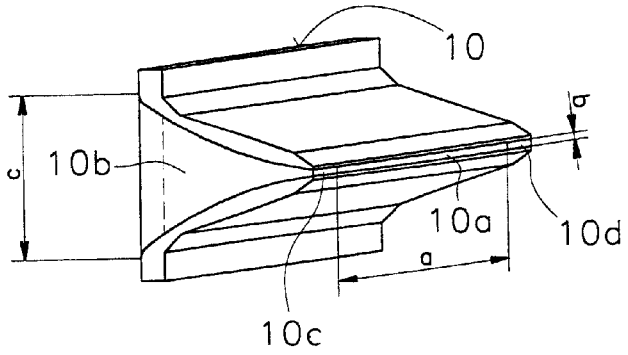
FIG. 4 is a perspective view of a preferred embodiment of the sliver trumpet according to the invention.
Figure 4A:
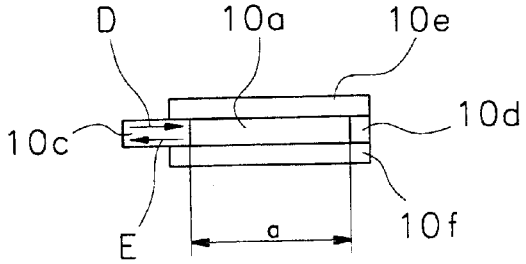
FIG. 4*a* is a front elevation of the sliver trumpet, showing an adjustable wall element in the outlet region.
Figure 4B:
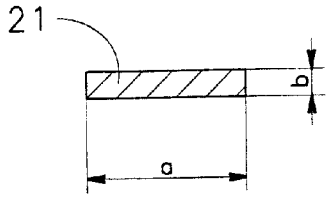
FIG. 4*b* is a cross-sectional view of the sliver exiting the sliver trumpet.

Turning to FIGS. 4, 4*a* and 4*b*, the walls of the web trumpet 10 converge in the advancing direction of the fiber material. The height c of the inlet opening 10*b* is greater than the height b (about 2–24 mm) of the outlet opening 10*a*. The width a of the outlet opening 10*a* of the web trumpet 10 is at least approximately 20–120 mm. Preferably, the width a is at least five times greater than the height b. As shown in FIG. 4*a*, the width a may be changed by providing, in the region of the outlet opening 10*a*, a wall element 10*c* which is shiftable in the direction of the arrows D, E. Wall elements 10*d*, 10*e* and 10*f* along with wall element 10*c* surround outlet opening 10*a*. The rectangular opening 10*a* has sharp bordering edges, as a result of which the flat sliver discharged by the web trumpet 10 has a sharp-edged cross-sectional configuration 21 as seen in FIG. 4*b*.

Figure 5:
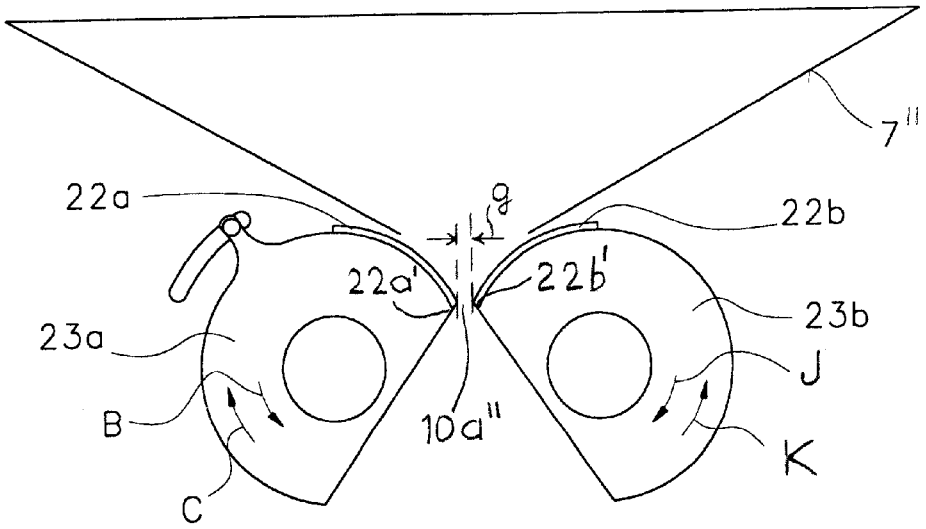
FIG. 5 is a schematic front elevational view of another preferred embodiment of the invention.

FIG. 5 illustrates a web gathering device 7" constituting a further embodiment. In its outlet region the web gathering device 7" has two convex guide elements 22*a,* 22*b*. The latter, in turn, have respective terminal edges 22*a*' and 22*b*' which together define a clearance g of the outlet opening of the web gathering device 7" through which the fiber material is pulled by means of the calender rolls 11, 12. Each arcuate guide element 22*a,* 22*b* is mounted on a respective circular setting element 23*a,* 23*b* which are rotatable in the direction of the respective arrows B, C and J, K. For effecting such a displacement, a setting mechanism is provided which may be operated manually or by a non-illustrated motor. By means of such a setting the size of the outlet opening 10*a*' of the web gathering device 7" may be adapted to the thickness (mass) of the discharged sliver.

Figure 6:
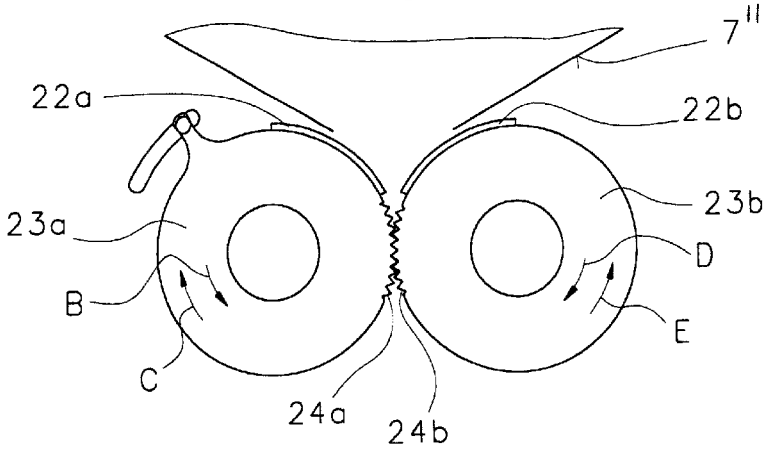
FIG. 6 is a schematic front elevational view of a further detail of the structure shown in FIG. 5.
Figure 6A:
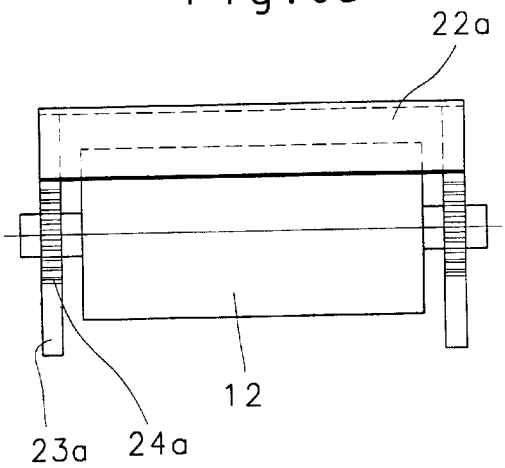
FIG. 6*a* is a schematic side elevational view of the structure shown in FIG. 6.

As shown in FIGS. 6, 6*a,* the setting elements 23*a,* 23*b* have, at their surfaces oriented towards one another, respective teeth 24*a,* 24*b* which mesh and roll off one another whereby a synchronization of the rotary motions of both setting element 23*a,* 23*b* is ensured.

Figure 7A:
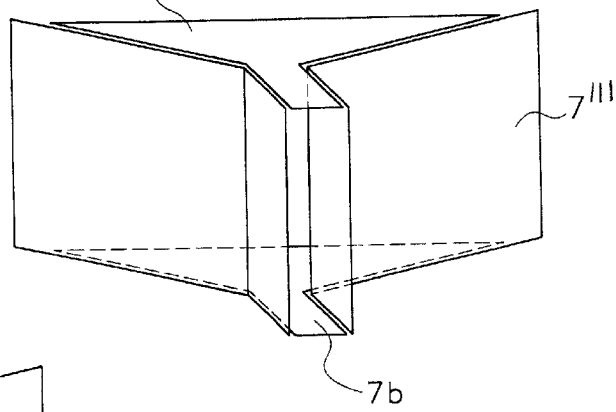
FIGS. 7*a* and 7*b* are schematic perspective views of a further preferred embodiment of the web gathering device showing height-adjustable top and bottom walls.
Figure 7B:
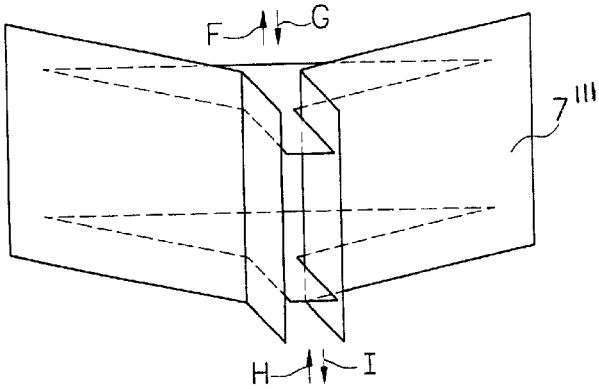

FIGS. 7*a* and 7*b* illustrate a web gathering device 7'" constituting a further embodiment. The top surface 7*a* and/or the bottom surface 7*b* of the web gathering device 7'" is shiftable in the direction of arrows F, G and H, I, respectively. In this manner the overall height of the gathering device 7'" may be adapted to the thickness (mass) of the processed and discharged fiber material.

Figure 8A:
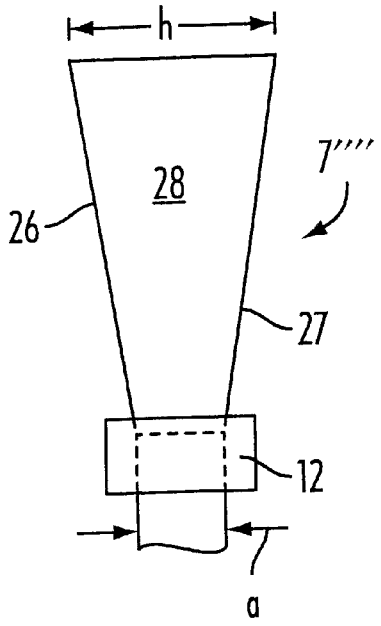
FIGS. 8*a* and 8*b* are schematic side elevational and, respectively, front elevational views of a further preferred embodiment of the invention.
Figure 8B:
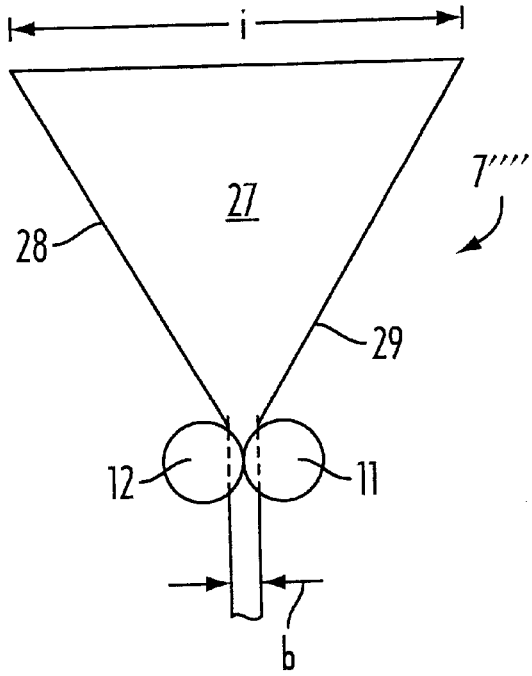

FIGS. 8*a* and 8*b* illustrate a web gathering device 7"" having four walls 26–29 defining a rectangular cross-sectional outline, having a long side i and a short side h. We opposite wails 20, 27 as well as the opposite walls 28, 29 converge in the direction of the calender rolls 11, 12.

It will be understood that the above description of the present invention is susceptible to various modifications, changes and adaptations, and the same are intended to be comprehended within the meaning and range of equivalents of the appended claims.

What is claimed is:

1. A fiber sliver producing apparatus comprising (a) means for making a running fiber web;

(b) a web gathering device having (1) a plurality of walls defining an inner space through which said fiber web runs in an advancing direction; said plurality of walls being stationary during operation of the apparatus;

(2) a web gathering portion causing the running fiber web to converge; said web gathering portion having an inlet opening and an exit opening and being closed on all sides except the inlet opening and the exit opening by the plurality of walls;

(3) a web densifying portion being situated downstream of said web gathering portion as viewed in said advancing direction for forming a running sliver from the web; said web densifying portion having an outlet opening for discharging the running sliver; said outlet opening having a cross-sectionally rectangular outline; said outlet opening having a width and a height; said width being at least five times greater than said height; and (c) a calender roll pair formed of two calender rolls through which said sliver passes after being discharged by said outlet opening; said calender roll pair defining a bight in which said outlet opening is disposed.

2. The apparatus as defined in claim 1, wherein said web gathering portion and said web densifying portion form a single, one-piece construction.

3. The apparatus as defined in claim 1, wherein two of said plurality of walls oppose one another and at least one of said two walls is movable relative to the other of said two walls for adjusting the volume of said inner space.

4. The apparatus as defined in claim 1, wherein said plurality of walls are composed of a first pair of facing walls mutually converging toward said calender rolls and a second pair of facing walls mutually converging toward said calender rolls; wherein said first and second pairs of facing walls define said inner space having a rectangular cross section.

5. The apparatus as defined in claim 1, wherein said web gathering device is a two-part structure formed of (a) a guide element constituting said web gathering portion; and (b) a sliver trumpet constituting said web densifying portion.

6. The apparatus as defined in claim 5, wherein said sliver trumpet has an outlet opening constituting said outlet opening of said web gathering device; further comprising a wall portion bounding said outlet opening; means for adjusting said outlet opening for varying said width of said outlet opening.

7. The apparatus as defined in claim 1, wherein said web gathering device and said advancing direction are downward-oriented relative to a horizontal plane.

8. The apparatus as defined in claim 1, further comprising adjusting means for setting the area size of said outlet opening.

9. The apparatus as defined in claim 8, wherein said adjusting means comprises (a) first and second adjoining, movable components;

(b) first and second surface portions carried by said first and second movable components, respectively; said first and second surface portions together defining a clearance; said clearance constituting said outlet opening; and (c) moving means for displacing said first and second components relative to one another for varying said area size.

10. A fiber sliver producing apparatus comprising:

(a) means for making a running fiber web;

(b) a web gathering device being downward oriented relative to a horizontal plane and having (1) a plurality of walls defining an inner space through which said fiber web runs in a downward oriented advancing direction; said plurality of walls being stationary during operation of the apparatus;

(2) a web gathering portion causing the running fiber web to converge; said web gathering portion having an inlet opening;

(3) a web densifying portion being situated downstream of said web gathering portion as viewed in said advancing direction for forming a running sliver from the web; said web densifying portion having an outlet opening for discharging the running sliver; said outlet opening having a cross-sectionally rectangular outline; said outlet opening having a width and a height; said width being at least five times greater than said height;

(c) a calender roll pair formed of two calender rolls through which said sliver passes after being discharged by said outlet opening; said calender roll pair defining a bight in which said outlet opening is disposed; and (d) a stripping roll forming a last component in a series of components constituting said means for making the running web; said stripping roll discharging the running web in the downward direction; said inlet opening of said web gathering device being positioned below said stripping roll for receiving the running web therefrom.

11. The apparatus as defined in claim 10, said means for making said fiber web further comprises a main carding cylinder, a doffer, a first shoving roll and a second shoving roll arranged consecutively in a series as viewed in a fiber processing direction of the apparatus; said second shoving roll immediately preceding said stripping roll; said shoving rolls and said stripping roll being at an increasingly greater height level than said doffer.

12. A fiber sliver producing apparatus comprising:

(a) means for making a running fiber web;

(b) a web gathering device having (1) a plurality of walls defining an inner space through which said fiber web runs in an advancing direction; said plurality of walls being stationary during operation of the apparatus;

(2) a web gathering portion causing the running fiber web to converge; said web gathering portion having an inlet opening;

(3) a web densifying portion being situated downstream of said web gathering portion as viewed in said advancing direction for forming a running sliver from the web; said web densifying portion having an outlet opening for discharging the running sliver; said outlet opening having a cross-sectionally rectangular outline; said outlet opening having a width and a height; said width being at least five times greater than said height;

(4) adjusting means for setting the area size of said outlet opening, said adjusting means comprising (a) first and second adjoining, movable components, said first and second components being rotatably supported;

(b) first and second surface portions carried by said first and second movable components, respectively, said first and second surface portions each being arcuate and each having a terminal edge, the terminal edge of said first arcuate surface portion and the terminal edge of said second arcuate surface portion together partially defining said outlet opening; and (c) moving means for displacing said first and second components relative to one another for varying said area size; and (c) a calender roll pair formed of two calender rolls through which said sliver passes after being discharged by said outlet opening; said calender roll pair defining a bight in which said outlet opening is disposed.

13. The apparatus as defined in claim 12, wherein said first and second components carry meshing teeth for effecting a synchronous motion of said first and second components.

* * * * *